US007581531B2

(12) United States Patent
Schulz

(10) Patent No.: US 7,581,531 B2
(45) Date of Patent: Sep. 1, 2009

(54) METHOD FOR OPERATING AN INTERNAL COMBUSTION ENGINE

(75) Inventor: Torsten Schulz, Yongin-Si (KR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/879,618

(22) Filed: Jul. 17, 2007

(65) Prior Publication Data

US 2008/0022978 A1 Jan. 31, 2008

(30) Foreign Application Priority Data

Jul. 19, 2006 (DE) ..... 10 2006 033 481

(51) Int. Cl.
*F02D 7/00* (2006.01)
*F02D 17/04* (2006.01)

(52) U.S. Cl. ..... 123/481; 123/198 DB

(58) Field of Classification Search ..... 123/481, 123/198 DB, 198 F, 325, 332; 701/112
See application file for complete search history.

(56) References Cited

U.S. PATENT DOCUMENTS

| | | | | |
|---|---|---|---|---|
| 5,732,680 | A * | 3/1998 | Ninomiya et al. | 123/481 |
| 5,813,383 | A * | 9/1998 | Cummings | 123/198 F |
| 7,028,661 | B1 * | 4/2006 | Bonne et al. | 123/198 F |
| 2002/0129789 | A1 * | 9/2002 | Furukawa et al. | 123/378 |
| 2003/0089330 | A1 * | 5/2003 | Azuma | 123/198 F |
| 2006/0144378 | A1 * | 7/2006 | Zillmer et al. | 123/679 |

* cited by examiner

*Primary Examiner*—Mahmoud Gimie
(74) *Attorney, Agent, or Firm*—Kenyon & Kenyon LLP

(57) ABSTRACT

An internal combustion engine includes multiple cylinders. A partial set of the cylinders may be temporarily shut off. Fuel is introduced briefly into at least one of the shut off cylinders and combusted in an at least essentially torque-neutral way during the cylinder shut off period.

11 Claims, 2 Drawing Sheets

METHOD FOR OPERATING AN INTERNAL COMBUSTION ENGINE

BACKGROUND INFORMATION

The overall efficiency of internal combustion engines, as they are currently used in motor vehicles, is typically maximal at those operating points which are close to full load and at low to moderate engine speeds. In partial-load operation, the energy contained in the fuel is not optimally utilized. As a result, the fuel consumption is higher than would be necessary per se. However, such partial-load operation is the normal operation in motor vehicles having high-performance internal combustion engines.

One may attempt to keep the operating point in the range of optimum efficiency as continuously as possible via an optimum design of manual shift transmissions and shifting strategies in automatic transmissions, for example, having a continuous transmission ratio. Another possibility is the concept of so-called "half-engine operation" in which one part of the cylinders operates at a comparatively high load and thus at a comparatively good efficiency. The other cylinders are shut off by interrupting the injection of fuel into these cylinders. For example, in an eight-cylinder internal combustion engine, four cylinders are shut off in this way.

An object of the present invention is to provide a method which allows low-emission operation of an internal combustion engine as much as possible while simultaneously allowing low fuel consumption.

SUMMARY OF THE INVENTION

The present invention allows compensation for a disadvantageous temperature loss in a shut off cylinder by brief and possibly repeated "heating operation." A shut off cylinder thus cools down less during the cylinder shut off period. When the cylinder shut off period ends, good mixture preparation is possible in the "preheated" cylinder which is now operating again, which in turn results in low emissions and a favorable fuel consumption in the internal combustion engine. Due to the at least essentially torque-neutral combustion of the fuel, the measure according to the present invention does not affect or at least does not detectably affect the comfort in the operation of the internal combustion engine, and without the cylinders which are not shut off having to depart from the optimal operating point for efficiency (high load). This has a favorable effect on the fuel consumption of the internal combustion engine. It is noted here that the method according to the present invention not only provides advantages during half-engine operation, but rather also during overrun fuel cutoff, for example, and the method according to the present invention may be used both in internal combustion engines having intake-manifold fuel injection and also in internal combustion engines having direct fuel injection.

In a preferred refinement of the method according to the present invention, fresh combustion air is introduced into the at least one shut off cylinder during the cylinder shut off period only in connection with the operating cycle(s) during which fuel is combusted. The work connected with the charge change is thus saved or at least reduced during a majority of the cylinder shut off period, and as much residual gas as possible may remain enclosed in the cylinder, which is also advantageous. The work needed for dragging along the shut off cylinder is thus reduced and the cooling of the corresponding cylinder combustion chamber is reduced via the resulting higher temperature level.

This may in turn be implemented in particular simply by opening at least one intake valve of the at least one shut off cylinder during the cylinder shut off period only in connection with the operating cycle(s) during which the fuel is combusted.

The additional fuel consumption due to the injection during the cylinder shut off period is minimal if precisely enough fuel and/or air is introduced into the cylinder, which is shut off per se, to at least approximately compensate, by the combustion of the fuel, for the pressure and/or temperature loss which occurred during preceding operating cycles since the last combustion. This may be implemented easily by opening the at least one intake valve of the at least one shut off cylinder for a significantly shorter time than a corresponding intake stroke lasts.

It is also suggested that at least one exhaust valve of the at least one shut off cylinder remain continuously closed during the cylinder shut off period. Therefore, a maximum residual gas quantity remains in the cylinder combustion chamber, which in turn minimizes the work needed for dragging along the shut off cylinder and the temperature loss.

In an advantageous refinement of the method according to the present invention, the instant of injection and/or combustion of fuel into the at least one shut off cylinder is made as a function of a temperature of the internal combustion engine and/or a number of operating cycles since the last combustion and/or a current engine speed. This ensures that the temperature and/or pressure of the internal combustion engine is held as accurately as possible at a desired level, without an unnecessarily large number of injections being necessary, which would unnecessarily worsen the fuel consumption and the emission behavior.

A simple possibility for the torque-neutral combustion suggested according to the present invention is to combust the introduced fuel at the end of an expansion stroke. At this instant, the piston of the corresponding cylinder is in the area of its bottom dead center, the lever arm on the crankshaft is thus comparatively poor and the cylinder pressure is comparatively low. Another possibility for a torque-neutral combustion is simply to inject such a small quantity of fuel at the end of a compression stroke that leakage losses and the cooling of the combustion chamber in drag operation are precisely compensated for by its combustion, but no or no noteworthy torque is produced.

DETAILED DESCRIPTION

Figure 1:
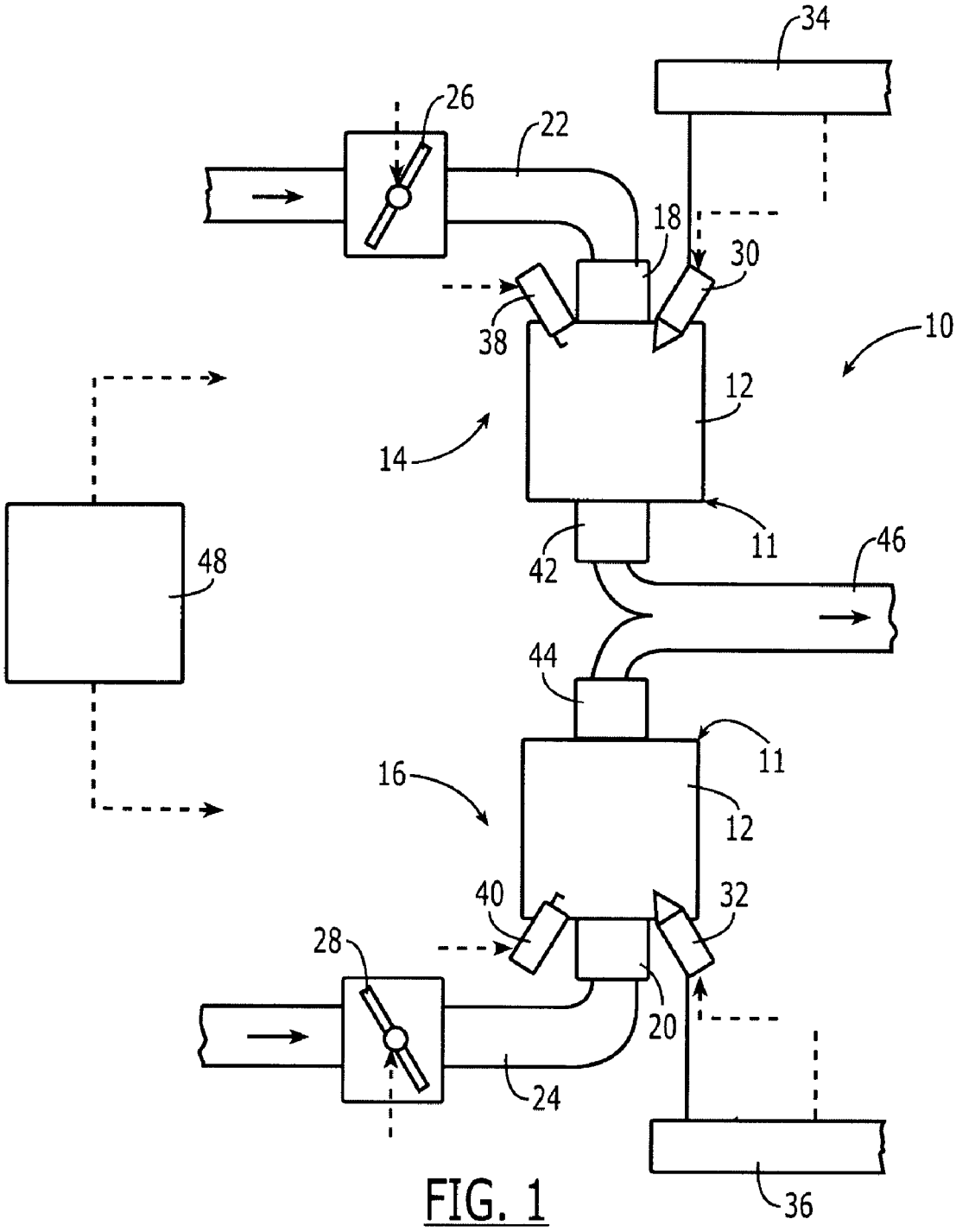
FIG. 1 shows a schematic illustration of an internal combustion engine.

An internal combustion engine carries reference numeral 10 as a whole in FIG. 1. It is used for driving a motor vehicle (not shown in FIG. 1). Internal combustion engine 10 includes multiple cylinders 11 having combustion chambers 12, of which only two are shown in FIG. 1 for the sake of simplicity. The totality of cylinders 11 is composed of a first partial set 14 of cylinders 11 and a second partial set 16 of cylinders 11. If a total of eight cylinders 11 are assumed, for example, first partial set 14 may include four cylinders 11 and second partial set 16 may also include four cylinders 11.

Combustion air reaches combustion chambers 12 in each case via an intake valve 18 or 20 and an intake manifold 22 or 24, respectively. A throttle valve 26 or 28 is situated in each intake manifold 22 or 24 belonging to a partial set 14 or 16, respectively. Fuel reaches combustion chambers 12 in each case directly via injectors 30 and 32. However, the following statements may also be applied to an internal combustion engine having intake manifold injection.

In the present internal combustion engine, a fuel pressure accumulator 34 or 36, referred to as a "rail," to which particular injectors 30 or 32 are connected, is assigned to each partial set 14 and 16 of combustion chambers 12. A fuel-air mixture located in combustion chambers 12 is ignited by a corresponding spark plug 38 or 40, and the hot combustion gases are discharged to an exhaust pipe 46 via exhaust valves 42 and 44.

Intake valves 18 and 20 and exhaust valves 42 and 44 are equipped with a variable valve gear (not shown), which allows them to be opened and closed completely independently of the position of a crankshaft or camshaft (neither shown) of internal combustion engine 10. The operation of internal combustion engine 10 is controlled and/or regulated by a control and regulating unit 48. This unit receives signals from various sensors, such as an accelerator pedal of the motor vehicle, using which a user may express a torque request, and from temperature, pressure, and other sensors which detect the current operating state of internal combustion engine 10.

To keep the fuel consumption of internal combustion engine 10 as low as possible during operation, if only moderate power is required of internal combustion engine 10, first partial set 14 of combustion chambers 12 of cylinders 11 may be shut off by interrupting the injection of fuel by injectors 30. In this case, the torque of internal combustion engine 10 is only still produced by the remaining second partial set 16 of cylinders 11 or combustion chambers 12, whose injectors 32 still directly inject fuel. If a higher output is again needed from internal combustion engine 10, the injection of fuel by injectors 30 into cylinders 11 or combustion chambers 12 of first partial set 14 is resumed. If fuel is injected into all combustion chambers 12 of first partial set 14 and second partial set 16, this is referred to as "full-engine operation"; in contrast, if the fuel supply to first partial set 14 of combustion chambers 12 is interrupted, this is referred to as "half-engine operation."

In half-engine operation of internal combustion engine 10 shown in FIG. 1, however, not only is the injection of fuel by injectors 30 interrupted, but rather intake valves 18 and exhaust valves 42 of corresponding cylinders 11 of first partial set 14 are permanently closed to save the work connected to the charge change in partial set 14 of cylinders 11. In addition, a comparatively large quantity of residual gas is thus enclosed in combustion chambers 12 of cylinders 11 of partial set 14. The work needed for dragging along shut off cylinders 11 of partial set 14 is thus reduced, and cylinders 11 of partial set 14 only cool off comparatively little from the higher temperature level.

Figure 2:
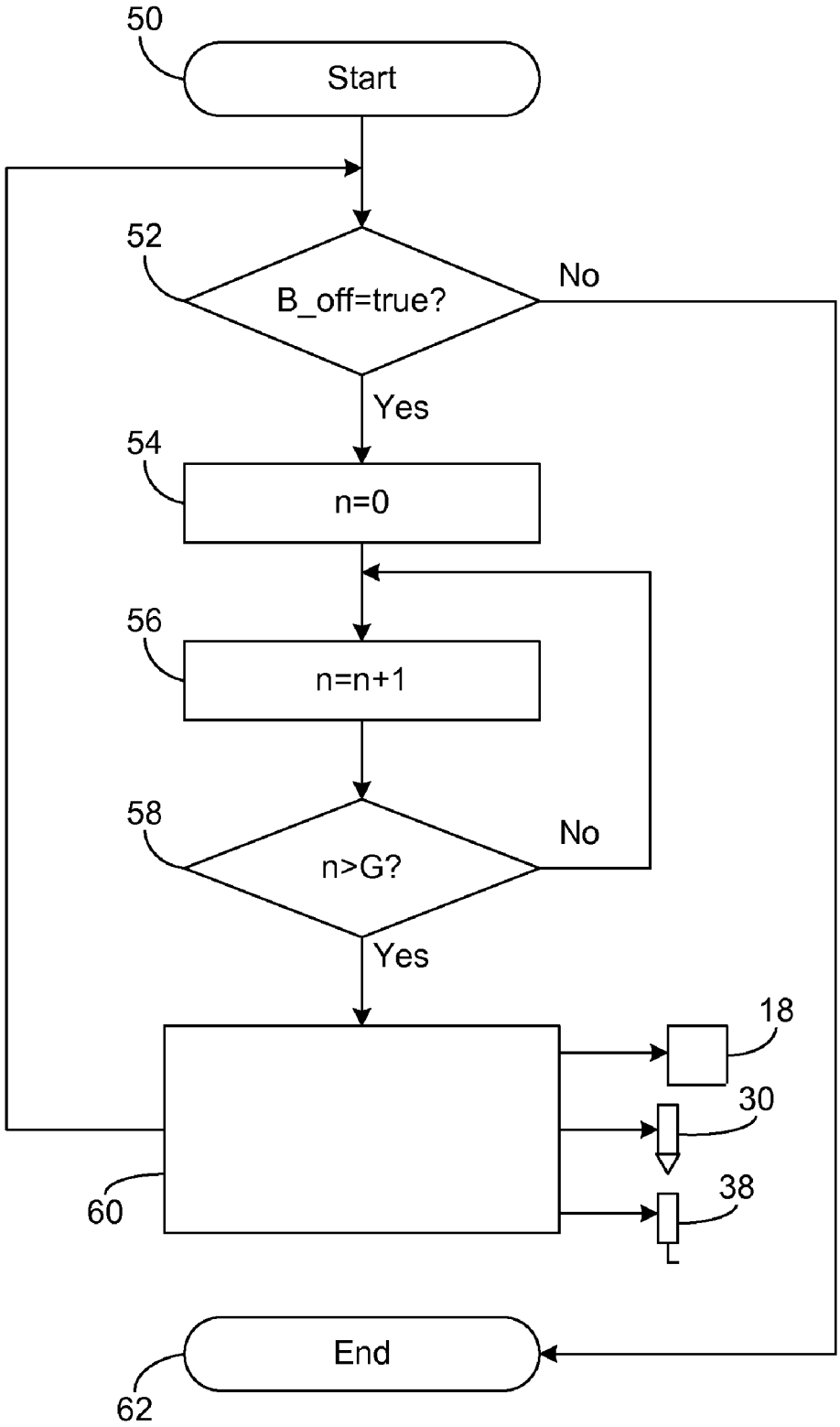
FIG. 2 shows a flow chart of a method for operating the internal combustion engine of FIG. 1.

However, because combustion chambers 12 of first partial set 14 of cylinders 11 are not closed gas-tight due to leaks at intake valves 18, exhaust valves 42, and scraper rings (not shown in FIG. 1) of the pistons (also not shown), the mean pressure and the temperature in combustion chambers 12 of first partial set 14 of cylinders 11 gradually sink in half-engine operation, i.e., when cylinders 11 are deactivated. The work to be applied during an operating cycle for the movement of the pistons of cylinders 11 of shut off first partial set 14 of combustion chambers 12 in turn increases, and corresponding cylinders 11 cool off more strongly, which may be disadvantageous in regard to the emissions arising when first partial set 14 is reactivated. To prevent this, a method is followed which will be explained in greater detail with reference to FIG. 2. This method is stored in the form of a computer program in a memory of control and regulating unit 48.

After a start in 50, it is checked in 52 whether a shut off period bit B_off has the value "true." This would mean that the shut off period of first partial set 14 of cylinders 11, i.e., half-engine operation, has been implemented by control and regulating unit 48. If the answer in 52 is yes, a counter n is set to zero in 54. Subsequently, counter n is incremented by 1 in 56. In 58, it is checked whether counter n is greater than a limiting value G. If the answer in 58 is no, the sequence jumps back to before 56. In contrast, if the answer in 58 is yes, on the one hand, the valve gear of intake valves 18 is briefly opened during an intake stroke of an operating cycle in 60. The opening duration is significantly shorter than the duration of the total intake stroke. On the other hand, injectors 30 are activated, so that they inject a small quantity of fuel into combustion chambers 12 of cylinders 11 of first partial set 14.

Spark plugs 38 are then activated in such a way that the air-fuel mixture now present in combustion chambers 12 of first partial set 14 of cylinders 11 is combusted at the end of the following expansion stroke. Exhaust valves 42 remain closed during the entire half-engine operation, however. Almost no torque is produced by the combustion of the fuel-air mixture at the end of an expansion stroke. Instead, the mean pressure and temperature are increased in combustion chambers 12 of first partial set 14 of cylinders 11.

Alternatively, fuel may also be injected and combusted entirely normally at the end of a compression stroke in first partial set 14 of cylinders 11. The quantity is solely to be selected as so small that leakage and cooling caused by drag operation are just compensated for, but no or no noticeable torque is produced. The advantage of such injection and combustion in the compression stroke is better emission behavior because of the higher temperatures in combustion chamber 12 in this operating phase.

From block 60, the sequence jumps back to before block 52. If it is established in 52 that bit B_off still has the value "true," intake valves 18 remain closed and no fuel is injected by injectors 30 until a specific number G of operating cycles is again exceeded in block 58. Thus, fresh combustion air is only introduced into combustion chambers 12 of first partial set 14 of cylinders 11 in connection with the operating cycle during which fuel is injected once by injectors 30 and subsequently combusted in a torque-neutral way. In contrast, if the answer in 52 is no, this means that the half-engine operation has ended. Fresh air is thus again also continuously supplied to combustion chambers 12 of cylinders 11 of first partial set 14, and fuel is also injected into these combustion chambers by injectors 30 in such a way that a normal torque is produced. The method then ends in 62.

What is claimed is:

1. A method for operating an internal combustion engine having multiple cylinders, in which at least a partial set of the cylinders is temporarily shut off, the method comprising:

briefly introducing fuel into at least one of the shut off cylinders and combusting fuel in an at least substantially torque-neutral way during a cylinder shut off period, wherein the introducing of the fuel does not turn the at least one of the shut off cylinders back on.

2. The method according to claim 1, further comprising introducing fresh combustion air into the at least one shut off cylinder during the cylinder shut off period only in connection with at least one operating cycle during which the fuel is combusted.

3. The method according to claim 2, wherein at least one intake valve of the at least one shut off cylinder is only opened during the cylinder shut off period in connection with the operating cycle during which the fuel is combusted.

4. The method according to claim 1, wherein only enough fuel and/or air is introduced that at least one of a pressure and temperature loss occurring during preceding operating cycles is at least substantially compensated for by the combustion of the fuel.

5. The method according to claim 3, wherein the at least one intake valve of the at least one shut off cylinder is open for a shorter time than a corresponding intake stroke lasts.

6. The method according to claim 1, wherein at least one exhaust valve of the at least one shut off cylinder remains closed during the cylinder shut off period.

7. A method for operating an internal combustion engine having multiple cylinders, in which at least a partial set of the cylinders is temporarily shut off, the method comprising:

briefly introducing fuel into at least one of the shut off cylinders and combusting fuel in an at least substantially torque-neutral way during a cylinder shut off period, wherein the introducing of the fuel does not turn the at least one of the shut off cylinders back on, and wherein at least one of (a) an instant of at least one of an injection and the combustion of fuel and (b) a fuel quantity injected into the at least one shut off cylinder is a function of at least one of a temperature of the internal combustion engine, a number of operating cycles since a last combustion and a current engine speed.

8. The method according to claim 1, wherein the introduced fuel is combusted at an end of one of an expansion stroke and a compression stroke, and a quantity selected is so small that substantially only leakage and cooling are compensated for.

9. A computer-readable medium containing a computer program which when executed by a processor performs a method for operating an internal combustion engine having multiple cylinders, in which at least a partial set of the cylinders is temporarily shut off, the method comprising:

briefly introducing fuel into at least one of the shut off cylinders and combusting fuel in an at least substantially torque-neutral way during a cylinder shut off period, wherein the introducing of the fuel does not turn the at least one of the shut off cylinders back on.

10. The computer-readable medium according to claim 9, wherein the medium is for a control/regulating unit of the engine.

11. A control/regulating unit for operating an internal combustion engine having multiple cylinders, in which at least a partial set of the cylinders is temporarily shut off, the operating performing a method the method comprising:

briefly introducing fuel into at least one of the shut off cylinders and combusting fuel in an at least substantially torque-neutral way during a cylinder shut off period, wherein the introducing of the fuel does not turn the at least one of the shut off cylinders back on.

* * * * *